United States Patent [19]

Bivins, Jr.

[11] 3,986,340

[45] Oct. 19, 1976

[54] METHOD AND APPARATUS FOR PROVIDING SUPERHEATED GASEOUS FLUID FROM A LOW TEMPERATURE LIQUID SUPPLY

[76] Inventor: Henry W. Bivins, Jr., 5030 Brummel, Skokie, Ill. 60076

[22] Filed: Mar. 10, 1975

[21] Appl. No.: 556,624

[52] U.S. Cl. ..... 62/53; 122/33; 165/105

[51] Int. Cl.[2] ..... F17C 7/02

[58] Field of Search ..... 62/52, 53; 122/33; 165/105; 126/360 A

[56] References Cited

UNITED STATES PATENTS

| | | | |
|---|---|---|---|
| 2,343,727 | 3/1944 | Zenner | 62/52 X |
| 2,975,607 | 3/1961 | Bodle | 62/52 X |
| 3,068,659 | 12/1962 | Marshall, Jr. | 62/52 |
| 3,183,666 | 5/1965 | Jackson | 62/53 X |
| 3,225,552 | 12/1965 | Farkas | 62/52 X |
| 3,421,574 | 1/1969 | Kals | 62/52 X |
| 3,535,210 | 10/1970 | Linde et al. | 62/52 X |
| 3,696,636 | 10/1972 | Mille | 62/52 X |
| 3,712,073 | 1/1973 | Arenson | 62/52 |
| 3,724,426 | 4/1973 | Brown | 122/33 |
| 3,738,353 | 6/1973 | Santoleri | 126/360 A |

FOREIGN PATENTS OR APPLICATIONS

| | | | |
|---|---|---|---|
| 584,192 | 9/1959 | Canada | 62/52 X |
| 920,657 | 3/1963 | United Kingdom | 165/105 |

*Primary Examiner*—William F. O'Dea
*Assistant Examiner*—Ronald C. Capossela
*Attorney, Agent, or Firm*—Wegner, Stellman, McCord, Wiles & Wood

[57] ABSTRACT

A method and apparatus for providing superheated gaseous fluid from a low temperature liquid supply wherein the liquid is provided to a closed chamber containing a heat transfer fluid to be in thermal transfer association with a vapor phase thereof. Heat is supplied to a liquid phase of the heat transfer fluid in the chamber to provide a continuous cycle of vaporization and condensation of the heat transfer fluid. A plurality of different heat sources may be provided for heating the heat transfer fluid, and one or more separate chambers may be utilized for heating the fluid.

21 Claims, 3 Drawing Figures

METHOD AND APPARATUS FOR PROVIDING SUPERHEATED GASEOUS FLUID FROM A LOW TEMPERATURE LIQUID SUPPLY

BACKGROUND OF THE INVENTION

1. Field of the Invention

This invention relates to vaporization of low temperature liquids.

2. Description of the Prior Art

It is common to provide different volatile fluids in the form of low temperature liquids permitting facilitated shipment and storage. When it is desired to utilize the fluid in gaseous form, heat is supplied to effect controlled vaporization. One such vaporizing device is shown in U.S. Pat. No. 2,343,727 of George H. Zenner.

In the Canadian Patent Office Record of Sept. 29, 1959, a disclosure of Canadian Pat. No. 584,192 of John B. Gardner was made, showing an apparatus for vaporizing liquefied gas by means of a stream of hot combustion products and heat exchange between first and second heat exchangers.

In U.S. Pat. No. 2,975,607 of William W. Bodle, liquefied natural gas is vaporized by use of sea water or air. The process includes the step of reducing the pressure of a vaporized heat transfer medium in a work producing zone and subsequently pressurizing condensed heat transfer medium resulting from a heat transfer association of the reduced pressure medium and the liquefied gas.

In Walton H. Marshall, Jr., U.S. Pat. No. 3,068,659 the low temperature liquid is heated by a heat exchange gas having a higher boiling point than the liquid. The vaporized heat transfer gas is expanded in an engine to produce an output energy.

In U.S. Pat. No. 3,183,666 of Robert Glover Jackson, liquefied gas is vaporized by means of heat indirectly transferred from the exhaust gases of an internal combustion engine and air to be delivered to the internal combustion engine.

In U.S. Pat. No. 3,421,574 of W. Kals, a liquid and apparatus for vaporizing and heating cold liquefied gas is disclosed wherein ambient air is utilized as the heat source of a heat transfer medium. The heat source is placed in heat exchange with the heat transfer medium in a first chamber and the vaporized heat source medium is transferred to a second chamber to be in heat transfer association with the liquefied gas to effect the desired vaporization thereof. Control of the delivery of the liquefied gas to the second heat exchanger is effected by a solenoid valve response to pressure differentials between the first chamber in which the heat transfer fluid is heated and the second chamber in which the heat transfer fluid is placed in heat exchange relationship with the liquefied gas.

SUMMARY OF THE INVENTION

The present invention comprehends a method and apparatus for providing superheated gaseous fluid from a low temperature liquid supply comprising a substantial improvement over the methods and apparatuses of the prior art as disclosed above. More specifically, applicant's invention comprehends providing a closed chamber having a heat transfer fluid therein defining a lower liquid phase portion and an upper vapor phase portion, heating the liquid phase portion to the saturation temperature thereof to cause vaporization thereof, and placing liquid from said supply in heat transfer association with said heat transfer fluid vapor phase portion to vaporize said fluid, effect super-heating of the vaporized liquid, and concurrently cause condensation of the vapor phase portion heat transfer fluid and falling of the condensate fluid directly into the lower liquid phase portion of the heat transfer fluid, the rate of delivery of the supply liquid and the rate of heating of said liquid phase portion being correlated to provide an equilibrium condition of the heat transfer fluid in the closed chamber wherein the temperature thereof is maintained at a preselected temperature.

In one disclosed embodiment, the condensed heat exchange fluid is caused to fall as drops into the liquid phase portion thereof for improved facilitated vaporization.

The heat source for providing heat to the heat transfer fluid may comprise waste heat conventionally dumped into the environment.

The heating of the heat transfer fluid may be effected by flowing water in heat transfer association therewith, and the minimum equilibrium temperature of the heat exchange fluid is preselected to prevent freezing of the water.

The invention further comprehends the provision of a plurality of closed heating chambers permitting the use of a plurality of different heat sources providing different rates of vaporization of the heat exchange fluid. The liquid to be vaporized may be placed in heat exchange relationship with the vapor phase of the heat exchange fluid in a single vaporization chamber to which the vaporized fluid from the different heat sources is delivered.

The different heating chambers may be suitably connected to provide a common liquid phase level for facilitated control of the heat transfer operation.

The method and apparatus of the present invention are extremely simple, while yet providing the highly desirable features described above.

DESCRIPTION OF THE PREFERRED EMBODIMENT

Figure 1:
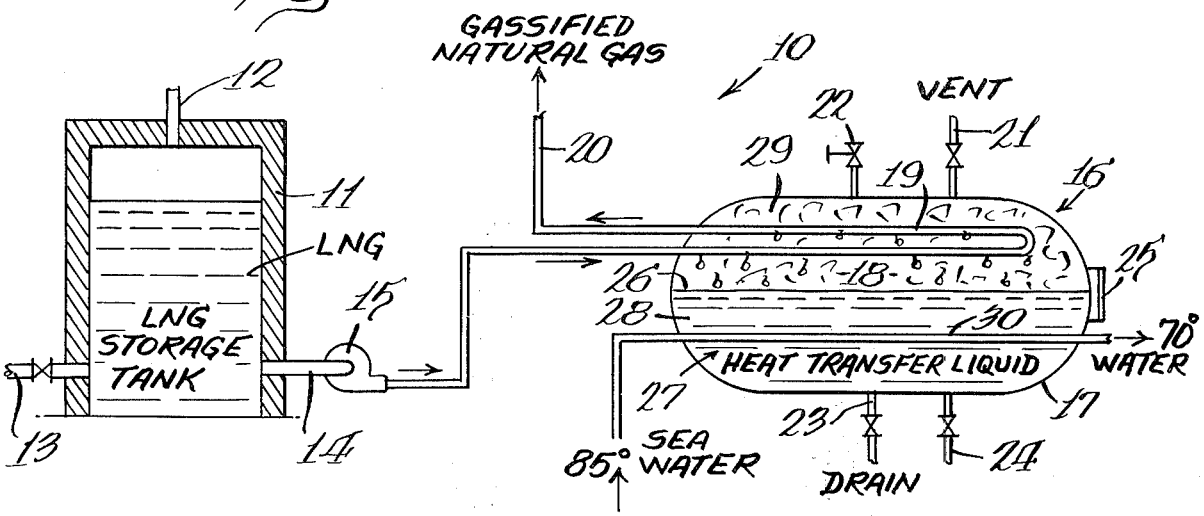
FIG. 1 is a schematic elevation of an apparatus embodying the invention for use in carrying out the method of the invention.

In the exemplary embodiment of the invention as disclosed in FIG. 1 of the drawing, an apparatus designated 10 is shown to comprise an apparatus for converting a cyrogenic liquid to a gas at a higher temperature. Illustratively, the liquid may comprise liquefied natural gas (LNG) which may be maintained in a suitable storage tank 11 at low temperature. Illustratively, the LNG may be maintained at a temperature of approximately −260° F. in tank 11. The tank may be provided with a suitable vent 12, a valved inlet 13 and an outlet 14.

The LNG may be pumped from tank 11 by a suitable pump 15 to a heat exhanger designated 16 defined by a tank 17 forming a heat transfer chamber 18. The LNG is passed through a heat exchanger tube 19 in a upper portion of chamber 18, and is delivered therefrom to an outlet 20 in the form of vaporized natural gas.

Tank 17 may be provided with a suitable valved vent 21, suitable relief valve 22, a valved drain 23, and a valved inlet 24. A reflex gauge glass 25 may be provided on tank 17 for permitting viewing of the level 26 of a heat transfer medium designated 27 provided in chamber 18.

The heat transfer medium comprises a vaporizable liquid such as ammonia, having a liquid phase 28 in the lower portion of chamber 18 and a gaseous phase 29 in the upper portion produced by suitable heating of the heat transfer medium. Such heating may, for example, be effected in chamber 18 by means of a heat exchanger tube 30 carrying a heat transfer liquid such as sea water.

In normal operation, tank 17 is closed so as to provide an equilibrium condition between the liquid phase 28 and vapor phase 29 of the heat exchange medium ammonia. Heat from the heat exchange duct 30 vaporized a portion of the liquid phase 28 to raise the ammonia vapor pressure along its saturation curve. The LNG flowed through duct 19 is substantially at its atmospheric pressure saturation temperature of −260° F.

As a result of the low temperature heat transfer from the LNG in duct 19, the vapor phase ammonia condenses, thereby lowering the vapor phase pressure along the ammonia saturation curve. The LNG absorbs heat from the condensing ammonia and is raised in temperature to approach the saturation temperature of the ammonia heat exchange medium. The condensed liquid ammonia falls in the form of drops back onto the upper surface 26 of the liquid phase, providing an agitation of the liquid phase and improved vaporization thereof in the heat exchanger 16. The liquid and vapor phases reach a liquid saturation temperature and pressure condition within tank 17 for continuous equilibrium operation of the apparatus. The apparatus is designed so that the liquid temperature is above the freezing temperature of the heat source liquid which, where the heat solution liquid is water, is approximately 32°. As will be obvious to those skilled in the art, the rate of delivery of the LNG may be correlated with the rate of heating of the liquid phase 28 of the heat transfer fluid 27 to provide such an equilibrium condition as by control of pump 15, control of the flow rate of the heat source liquid, etc.

The invention comprehends that a wide range of heat sources may be utilized in connection with apparatus 16. In the illustrated embodiment, sea water at 85° F. is utilized to provide the vaporized natural gas output at approximately 40° F. Where the heating water temperature is relatively low, such as 40° F., the gas discharge temperature may be approximately 0° to 10° F.

While the invention is disclosed in connection with the vaporization of LNG, as will be obvious to those skilled in the art, it is equally applicable to the vaporization of other cryogenic liquids, such as liquid oxygen, liquid nitrogen, etc.

The heat transfer ammonia may comprise a commercial fertilizer grade thereof. As will be obvious to those skilled in the art, other suitable heat transfer liquids, such as propane, freon, etc., may be utilized within the scope of the invention.

Figure 2:
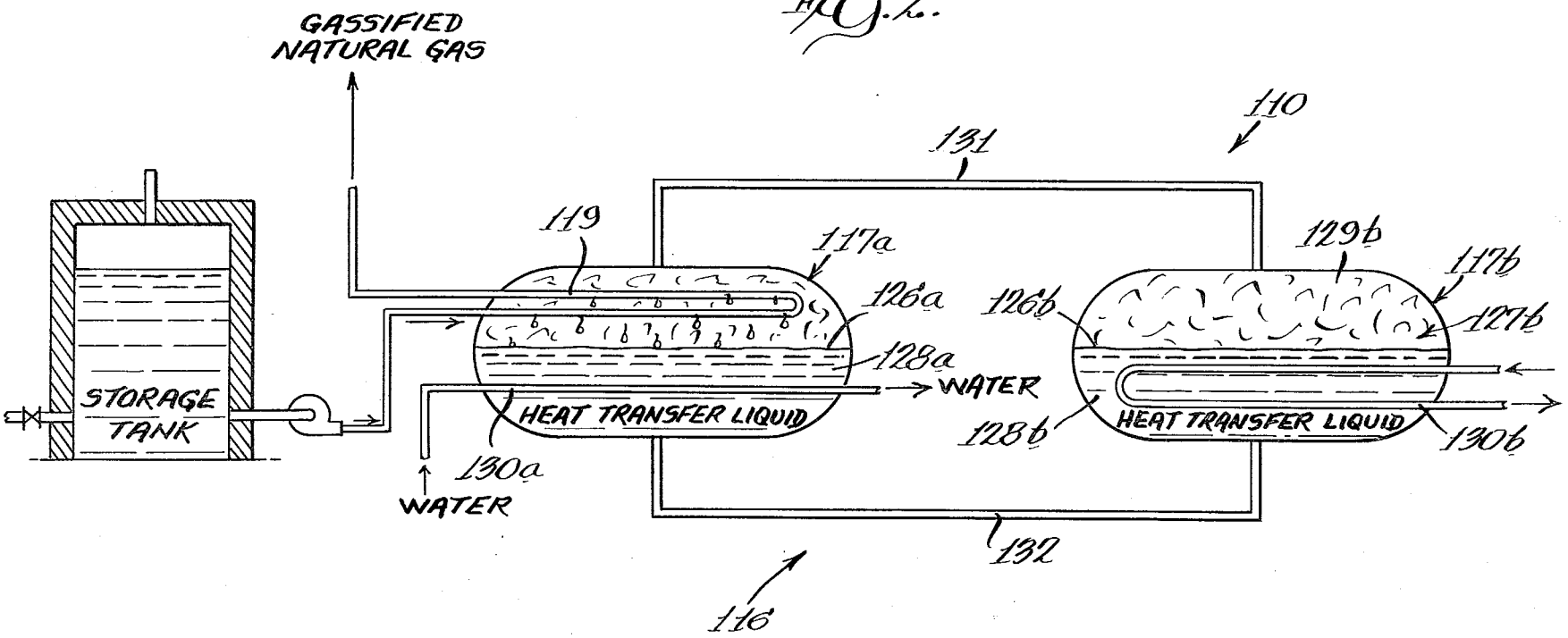
FIG. 2 is a schematic elevation of a modified form of such apparatus.

Referring now to FIG. 2, a modified form of apparatus designated 110 embodying the invention is shown to comprise a pair of heat exchanger tanks 117*a* and 117*b* defining a multiple heat source heat exchanger apparatus designated 116. As shown, a first heating means 130*a* may be provided in tank 117*a* and a second heating means 130*b* may be provided in tank 117*b*. Means 119 for placing the LNG in heat transfer association with the heat transfer means may be provided in tank 117*a*. The liquid phase heat exchange medium 128*a* in tank 117*a* is delivered directly into heat exchange association with duct means 119. The vapor phase 129*b* of the heat exchange medium 127*b* in tank 117*b* is delivered through a suitable transfer duct 131 to the upper portion of tank 117*b*. Thus, heated vaporized heat transfer fluid is delivered into heat exchange association with heat transfer duct 119 from both heat exchanger tanks 117*a* and 117*b*. The upper level 126*a* of the liquid phase 128*a* of the heat exchanger medium in the tank 117*a* is equalized with upper level 126*b* of the liquid phase 128*b* in tank 117*b* by means of an equalizing duct 132 interconnecting the lower portions of tanks 117*a* and 117*b*.

In the embodiment of FIG. 2, a plurality of different heat sources may be utilized for effecting the heating of the heat transfer medium.

Figure 3:
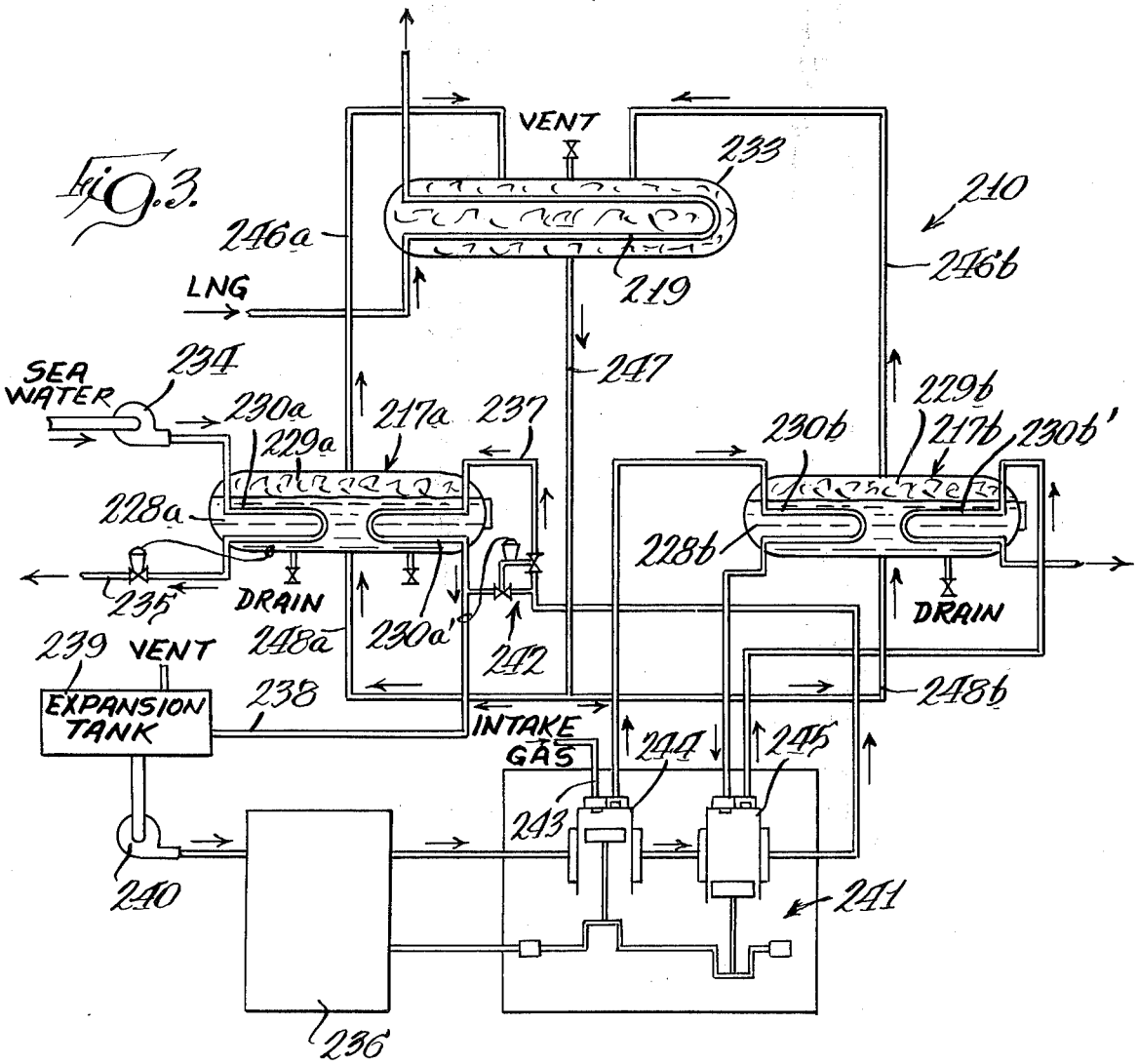
FIG. 3 is a schematic elevation illustrating a further modified form of apparatus for practicing the invention.

Referring now to FIG. 3, a further modified form of apparatus designated 210 embodying the invention is shown to comprise an apparatus generally similar to apparatuses 10 and 110, but utilizing a separate heat exchanger tank 233 for effecting the desired heat exchange between the LNG and the vapor phase of the heat exchange medium. As shown in FIG. 3, the heating of the heat exchange medium may be effected in a plurality of heat exchanger tanks 217*a* and 217*b*. Illustratively, each tank may be provided with a plurality of heat source means such as heat source duct 230*a* and heat source duct 230′ in tank 217*a* and heat source duct 230*b* and heat source duct 230″ in tank 217*b*.

Heat source duct 230*a* may be provided with sea water by means of a suitable pump 234 and valved outlet 235. Heating duct 230*a′* may be connected to the water jacket cooling circuit of a natural gas engine drive 236, including a delivery duct 237 and a return duct 238 provided with a vented expansion tank 239. The water jacket cooling liquid may be flowed through the system by a suitable pump 240. The cooling water may additionally be flowed through a compressor 241 in series with the gas engine drive. A suitable valve control 242 may be provided for regulating the temperature of the water jacket cooling water as desired.

Compressor 241 may comprise a two-stage compressor air intake. Gas is delivered through an inlet 243 to the first stage 244 of the compressor. Heat from the compressed gas leaving the first stage 244 is delivered through duct 230*b* in tank 217*b* to the liquid phase 228*b* of the heat transfer medium therein. The compressed gas may be further compressed in a second stage 245 of compressor 241 and the heating thereof utilized for further heating the liquid phase 228*b* by passing of the further compressed gas through the duct 230*b′* in tank 217*b*. In the illustrated embodiment, the inter-stage gas cooling and the after cooling effected by heat exchange ducts 230*b* and 230*b′* respectively are uncontrolled.

The vapor phase heat exchange fluid 229*a* in tank 217*a* and 229*b* in tank 217*b* is delivered through suitable ducts 246*a* and 246*b* to the upper portion of tank 233 where the vapor phase heat exchange fluid is placed in heat exchange relationship with the LNG flowed through a heat transfer duct 219 therein.

The condensed heat exchange fluid is returned to the tanks 217*a* and 217*b* through a return duct 247 leading from the lower portion of tank 233 and branch return ducts 248*a* and 248*b* connected to tanks 217*a* and 217*b*, respectively. Thus, as disclosed, in connection with the multi-tank embodiment of FIG. 2, the liquid phase level is equalized in each of the tanks in apparatus 210 for facilitated vaporization of the LNG.

Other than as discussed above, the embodiments of each of FIGS. 2 and 3 similar to that of FIG. 1, and elements of the apparatus of FIGS. 2 and 3 are identified by similar reference numerals except 100 different in the three embodiments.

The flow through heat transfer duct of the liquid to be vaporized may be preselected to cause the vaporized liquid to approach the temperature of the vapor phase heat exchange medium at the equilibrium conditions.

As the liquid phase of the heat exchange medium provides a large variable temperature heat sink, a plurality of different heat sources may be readily utilized without the need for expensive temperature regulating controls by the simple expedient of modulating the heat sources sufficiently to prevent freezing of the heat transfer liquid or lowering of the temperature of the system below the minimum desired equilibrium temperature.

Thus, the present invention permits the use of low level heat sources without problems of freezing, etc., and allows the use of such low level heat sources with high efficiency. As there is no high temperature heat source involved with the heat exchangers they may be placed closely adjacent the storage tank of the liquid to be vaporized and low cost ducts may be utilized.

The use of ammonia as the heat transfer medium provides the advantages of ready availability, low cost, high heat transfer coefficients and ready detection of leaks.

Where the liquid being vaporized comprises LNG, the system may be arranged to provide the output gaseous natural gas at approximately the temperature of the gas distribution system such as approximately 50° F.

The foregoing disclosure of specific embodiments is illustrative of the broad inventive concepts comprehended by the invention.

I claim:

1. The method of providing superheated gaseous fluid from a low temperature liquid supply of said fluid comprising the steps of:

providing a closed chamber having heat transfer fluid therein defining a lower liquid phase portion and an upper vapor phase portion;

heating the liquid phase portion to the saturation temperature thereof to cause vaporization thereof; and placing liquid from said supply in heat transfer association with only said heat transfer fluid vapor phase portion in said closed chamber to vaporize said liquid, effect superheating of the vaporized liquid, and concurrently cause condensation of vapor phase portion heat transfer fluid and falling of the condensed fluid directly into the lower liquid phase portion of the heat transfer fluid, the rate of delivery of the supply liquid being selected such that the rate of heating of said liquid phase portion provides an equilibrium condition of the heat transfer fluid in the closed chamber wherein the temperature of the heat transfer fluid phase portion is maintained above a preselected minimum temperature.

2. The method of providing superheated gaseous fluid from a low temperature liquid supply of said fluid of claim 1 wherein the condensed fluid is caused to fall as drops into the liquid phase portion of the heat exchange fluid.

3. The method of providing superheated gaseous fluid from a low temperature liquid supply of said fluid of claim 1 wherein said heating step utilizes waste heat normally dumped into the environment.

4. The method of providing superheated gaseous fluid from a low temperature liquid supply of said fluid of claim 1 wherein said heating step comprises flowing water in heat transfer association with said liquid phase heat transfer fluid and said preselected minimum temperature comprises the freezing temperature of the water.

5. The method of providing superheated gaseous fluid from a low temperature liquid supply of said fluid of claim 1 wherein said heating step comprises a step of delivering different heat source means in heat transfer association with said liquid phase in said closed chamber.

6. The method of providing superheated gaseous fluid from a low temperature liquid supply of said fluid of claim 1 wherein said closed chamber is defined by a plurality of closed containers, and duct means for conducting vapor phase and liquid phase heat exchange fluid between the containers.

7. The method of providing superheated gaseous fluid from a low temperature liquid supply of said fluid of claim 1 wherein said closed chamber is defined by a plurality of closed containers, and duct means for conducting vapor phase and liquid phase heat exchange fluid between the containers, said heating of the liquid phase being effected in a plurality of said containers.

8. The method of providing superheated gaseous fluid from a low temperature liquid supply of said fluid of claim 1 wherein said closed chamber is defined by a plurality of closed containers, and duct means for conducting vapor phase and liquid phase heat exchange fluid between the containers, said heating of the liquid phase being effected in a plurality of said containers and said placing of the supply liquid in heat transfer association with the heat transfer fluid vapor phase being effected in less than all of said containers.

9. The method of providing superheated gaseous fluid from a low temperature liquid supply of said fluid of claim 1 wherein said closed chamber is defined by a plurality of closed containers, and duct means for conducting vapor phase and liquid phase heat exchange fluid between the containers, said heating of the liquid phase being effected in each of said containers.

10. The method of providing superheated gaseous fluid from a low temperature liquid supply of said fluid of claim 1 wherein said closed chamber is defined by a plurality of closed containers, and duct means for conducting vapor phase and liquid phase heat exchange fluid between the containers, said heating of the liquid phase being effected in a plurality of said containers and said placing of the supply liquid in heat transfer association with the heat transfer fluid vapor phase being effected in only one of said containers.

11. The method of providing superheated gaseous fluid from a low temperature liquid supply of said fluid of claim 1 wherein said liquid supply comprises liquid natural gas and said heat exchange fluid comprises ammonia.

12. The method of providing superheated gaseous fluid from a low temperature liquid supply of said fluid of claim 1 wherein said liquid supply comprises liquid natural gas, said heat exchange fluid comprises ammonia, and said heating step comprises flowing water in heat transfer relationship with the liquid ammonia in said chamber.

13. The method of providing superheated gaseous fluid from a low temperature liquid supply of said fluid comprising the steps of:

providing a plurality of closed heating chambers each having heat transfer fluid therein defining a lower liquid phase portion and an upper vapor phase portion;

providing heat from a plurality of different sources for heating the liquid phase portions in said chamber to the saturation temperature thereof to cause vaporization thereof;

providing a closed receiver chamber for receiving vapor phase heat transfer fluid from said heating chamber;

placing liquid from said supply in heat transfer association with said vapor phase heat transfer fluid in said receiver chamber to vaporize said liquid, effect superheating of the vaporized liquid, and concurrently cause condensation of vapor phase portion heat transfer fluid; and returning the condensed fluid to said heating chamber, the rate of delivery of the supply liquid being selected such that the rate of heating of said liquid phase portion provides an equilibrium condition of the heat transfer fluid in the closed chamber wherein the temperature of the heat transfer fluid phase portion is maintained above a preselected minimum temperature.

14. The method of providing superheated gaseous fluid from a low temperature liquid supply of said fluid of claim 13 wherein one of said heat sources comprises environmental water.

15. The method of providing superheated gaseous fluid from a low temperatutre liquid supply of said fluid of claim 13 wherein one of said heat sources comprises engine cooling jacket water.

16. The method of providing superheated gaseous fluid from a low temperature liquid supply of said fluid of claim 13 wherein one of said heat sources comprises compressed gas.

17. The method of providing superheated gaseous fluid from a low temperature liquid supply of said fluid of claim 13 wherein the level of the liquid phase heat transfer fluid in said plurality of heating chambers is equalized.

18. The method of providing superheated gaseous fluid from a low temperature liquid supply of said fluid of claim 13 wherein the vapor phase heat transfer fluid for each heating chamber is separately delivered to said receiver chamber.

19. Apparatus for providing superheated gaseous fluid from a low temperature liquid supply of said fluid, comprising:

means defining a closed chamber having heat transfer fluid therein defining a lower liquid phase portion and an upper vapor phase portion;

means for heating said liquid phase portion to the saturation temperature thereof to cause vaporization thereof;

means for placing liquid from said supply in heat transfer association with only said heat transfer fluid vapor phase portion in said closed chamber to vaporize said liquid, effect superheating of the vaporized liquid, and concurrently cause condensation of vapor phase portion heat transfer fluid and falling of the condensed fluid directly into the lower liquid phase portion of the heat transfer fluid; and means for causing the rate of delivery of the supply liquid and the rate of heating of said liquid phase portion to provide an equilibrium condition of the heat transfer fluid in the closed chamber wherein the temperature thereof is maintained above a preselected minimum temperature.

20. Apparatus for providing superheated gaseous fluid from a low temperature liquid supply of said fluid, comprising:

means defining a closed chamber having heat transfer fluid therein defining a lower liquid phase portion and an upper vapor phase portion;

means for heating said liquid phase portion to the saturation temperature thereof to cause vaporization thereof;

means for placing liquid from said supply in heat transfer association with said heat transfer fluid vapor phase portion to vaporize said liquid, effect superheating of the vaporized liquid, and concurrently cause condensation of vapor phase portion heat transfer fluid and falling of the condensed fluid directly into the lower liquid phase portion of the heat transfer fluid;

means for causing the rate of delivery of the supply liquid and the rate of heating of said liquid phase portion to provide an equilibrium condition of the heat transfer fluid in the closed chamber wherein the temperature thereof is maintained above a preselected minimum temperature;

means defining a second closed chamber having heat transfer fluid therein defining a lower liquid phase portion and an upper vapor phase portion;

means for heating said liquid phase portion in said second closed chamber to the saturation temperature; and means for delivering vapor phase heat transfer fluid from said second chamber to said first chamber and liquid phase heat transfer fluid from said first chamber to said second chamber.

21. Apparatus for providing superheated gaseous fluid from a low temperature liquid supply of said fluid, comprising:

means defining a closed chamber having heat transfer fluid therein defining a lower liquid phase portion and an upper vapor phase portion;

means for heating said liquid phase portion to the saturation temperature thereof to cause vaporization thereof;

means for placing liquid from said supply in heat transfer association with said heat transfer fluid vapor phase portion to vaporize said liquid, effect superheating of the vaporized liquid, and concurrently cause condensation of vapor phase portion heat transfer fluid and falling of the condensed fluid directly into the lower liquid phase portion of the heat transfer fluid;

means for causing the rate of delivery of the supply liquid and the rate of heating of said liquid phase portion to provide an equilibrium condition of the heat transfer fluid in the closed chamber wherein the temperature thereof is maintained above a preselected minimum temperature;

means defining a second closed chamber wherein said means for placing liquid from said supply in heat transfer association with said heat transfer fluid vapor phase portion is effected;

a third chamber having heat transfer fluid therein defining a lower liquid phase portion and an upper vapor phase portion;

means for heating said liquid phase portion in said third closed chamber to saturation temperature; and means for delivering vapor phase heat transfer fluid from said third chamber to said second chamber and liquid phase heat transfer fluid from said second chamber back to said first and third chambers.

* * * * *